US006871706B2

(12) United States Patent
Hennessey

(10) Patent No.: US 6,871,706 B2
(45) Date of Patent: Mar. 29, 2005

(54) CASING CENTRALIZER

(76) Inventor: Albert Hennessey, 7612-17 Street, Edmonton, Alberta (CA), T6P 1P1

( * ) Notice: Subject to any disclaimer, the term of this patent is extended or adjusted under 35 U.S.C. 154(b) by 0 days.

(21) Appl. No.: 10/106,682

(22) Filed: Mar. 25, 2002

(65) Prior Publication Data

US 2003/0178193 A1 Sep. 25, 2003

(51) Int. Cl.[7] ..... E21B 19/24
(52) U.S. Cl. ..... 166/241.6
(58) Field of Search ..... 166/241.6, 241.7; 175/325.5

(56) References Cited

U.S. PATENT DOCUMENTS 3,356,147 A * 12/1967 Dreyfuss ..... 166/241.7
4,042,022 A 8/1977 Wills et al. ..... 166/241
4,143,713 A * 3/1979 Kreft ..... 166/241.7
4,269,269 A * 5/1981 Wilson ..... 166/241.7
4,520,869 A * 6/1985 Svenson ..... 166/241.7
4,651,823 A * 3/1987 Spikes ..... 166/241.7
4,909,322 A 3/1990 Patterson et al. ..... 166/241

* cited by examiner

*Primary Examiner*—David Bagnell
*Assistant Examiner*—Matthew J Smith
(74) *Attorney, Agent, or Firm*—Christensen O'Connor Johnson Kindness PLLC

(57) ABSTRACT

A casing centralizer having a pair of longitudinally spaced collars adapted to be assembled about a conduit, and a plurality of outwardly bowed springs extending longitudinally between the collars. Each collar has internal and external upsets formed therein. The external upsets are generally U shaped to receive the end of the bow spring. Each bow spring has an opening at each end thereof adapted to receive the internally upset material, with the internally upset material so formed to extending into the bow spring opening thereby locking the end portion of the bow spring within the externally formed U shaped upsets.

1 Claim, 4 Drawing Sheets

CASING CENTRALIZER

FIELD OF THE INVENTION

This invention relates generally to casing centralizer of the type which are mounted on oil, gas or water well casings, tubings and similar conduit strings for maintaining substantially equal clearance between such strings and the wellbore.

BACKGROUND OF THE INVENTION

As is well known in the art, such centralizers normally comprise a pair of axial spaced collars that are connected with a multiple of bow springs. The bow springs are bowed outwardly intermediate their ends so as to engage the wellbore. Such bow springs are equally spaced about the collars to enable the centralizer to maintain the conduit in the center of the well bore.

The attachment method for securing the bow springs to the collars is generally achieved through either a welding process or through a method where by the collars have been formed to receive the ends of the bow springs and firmly attach them to the collar. The centralizers that have been constructed using a welding process produce a low weight to volume ratio making them more costly to ship then centralizers that can be assembled at their point of use avoiding the welding process that may not readily be available. Centralizers that can be shipped in a disassembled state provides for assembly at destination and a subsequent reduction in shipping expenditure. Being in the disassembled condition also permits for different bow springs to be assembled within the collars to produce a variety of centralizers.

The materials used for the bow springs are hardened to produce the spring effect required for centering the conduit within the wellbore, the strength of such material being higher then that of the material used within the collar. Nominal strength material is used for the manufacture of the collar to economize the cost of goods.

Centralizers of a non-weld construction utilize openings within the collars to accept the bow springs that have a formed upset that projects into the collar opening. U.S. Pat. Nos. 4,909,322; 3,356,174 and 4,042,022 show centralizers of this type in which the collars are formed with an opening in the collar where a portion of the opening material has been retained to receive formed portions on the ends of the bow springs, and tabs on one or both sides of the openings which extend inwardly from the inner opening of the collars, so that when the formed section of the bow springs are so received, the tabs may be bent over the outer surfaces of the formed section to retain the ends of the springs against the inner surfaces of the collars, and thus hold the bent portions within the collar openings to secure the ends of the bow springs to the collars. The ends of the bow springs have been formed to be received within the opening of the collar. Within the opening of the collar there are portions of material that has been retained for use in securing the formed section of the bow spring ends within the opening of the collar, such portions of material are usually being opened ended and then bent into a position to achieve the locking of the formed section of the bow spring within the opening of the collar. The subsequent bending of the material may require multiple bends to achieve the locking of the formed bow spring section into the formed collar opening. It is therefore the object of this invention to provide a method of attaching the bow springs within the collar wherein the method of manufacture economizes on the amount of metal removed and bending of material used to secure the bow spring within the collar opening. Through a reduction of the collar material and bending of the same, strength in the subsequent attachment of the bow spring to the collar can be achieved. The reduction of material removal and forming of the collar material will economize the cost of goods.

SUMMARY OF THE INVENTION

This and other objects are accomplished, in accordance with the illustrated embodiments of the invention, by a centralizer of this type wherein each collar has external upsets formed therein and intermediate the external upsets the collar retains the material in an internally upset condition prior to assembly. Each bow spring has an opening at each end thereof adapted to fit within the area between the external collar upsets. More particularly, as in the above described centralizers, the material intermediate the external upset is bendable into the opening in the end of each end of the bow spring so as to hold the outer surface of the end of the bow spring tightly against the inner surface of the external collar upsets.

Preferably, each such collar has a pair of laterally spaced openings formed therein and each bow spring has an opening that is positioned central to the collar upsets that during the assembly process the internal upset intermediate the collar external upsets is pressed into the bow spring opening to securely fasten the bow spring to the collar.

In the illustrated embodiment of the invention, each collar has a pair of outwardly recessed portions in which the openings are formed and of a size to receive the end of the bow spring with its inner surface substantially flush with the inner surfaces of the collar on opposite sides of the recessed portions.

BRIEF DESCRIPTION OF THE DRAWINGS

In the drawings, wherein like reference characters are used throughout to designate like parts.

DETAILED DESCRIPTION OF THE PREFERRED EMBODIMENT

Figure 1:
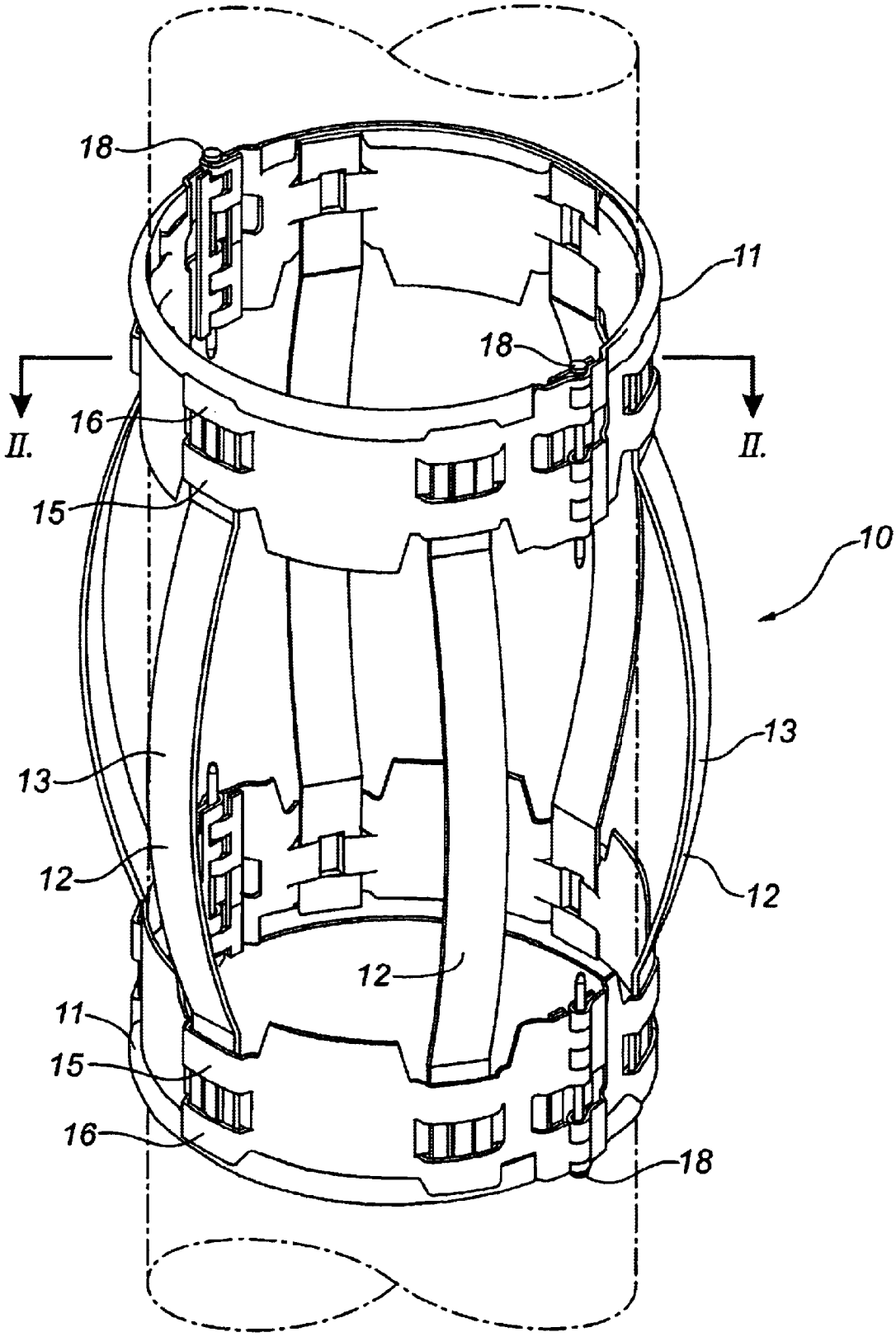
FIG. 1 is a side elevational view of a centralizer constructed in accordance with present invention.
Figure 2:
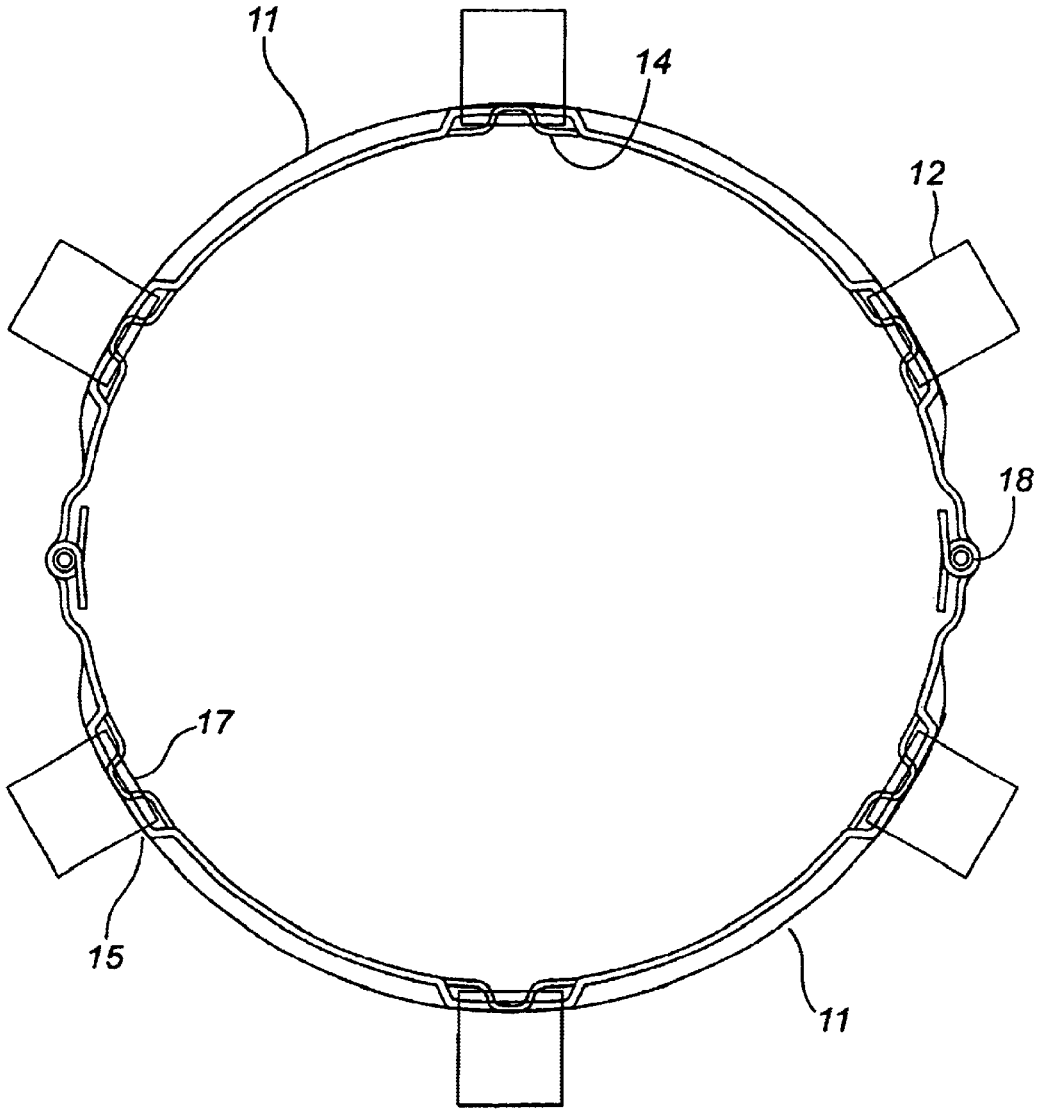
FIG. 2 is a top plan view of the centralizer, as seen along broken lines 2—2 of FIG, 1.

With reference now to the details of the above described drawings, the overall centralizer, indicated in its entirety by reference character 10 is shown to comprise a pair of longitudinally spaced collars 11 for assembly about the casing and bow springs 12 extending longitudinally between the collars. Each collar is made up of hinged connected accurate sections, in this case two, adapted to be wrapped around the casing and then suitably latched to one another by hinge pins, all as well known in the art. Each bow spring 12 includes an outwardly bowed portion 13 intermediate its ends 14 which are secured to the collars in a manner to be described to follow.

The collars are preferably identical, although one of them maybe otherwise formed. The novel collar, in this instance, is of the split type, with the halves being latched to one another by hinge pins 18 although the collar maybe produced in multiple sections, such sections latched to one another to form a complete collar.

Annularly disposed about the collar, in accordance with the number of bow springs to be used, are external upsets, generally designated 15 and 16, conveniently formed by slitting the material during the forming operation. Each external upset has upper and lower shoulders 19 and 20 that are axially spaced apart a distance substantially equal to the length of the opening 21 in the end of the bow spring. Annularly disposed about the collar, in accordance with the number of bow springs to be used, projecting from the collar from each side of the face portion are internal upsets generally designated 17 that are formed to project inwards an amount at least equal to the thickness of the bow spring element portion 14. The internal upset 17 between the upper and lower shoulders is formed with an internal upset projecting inward during the forming process. The upsets so that these latter portions, in the assembly, will be within the general confines of the inner surface of the collar.

In operation, the centralizer will first be assembled of collars and bow springs of the desired size and configuration. The end portion of each such bow spring will be inserted through the opening between the external upsets and the internal upset to the position where the opening in the bow spring has been positioned to align with the internal upset. The bow spring end element will be nested in the external upset portions of the collar.

Figure 4:
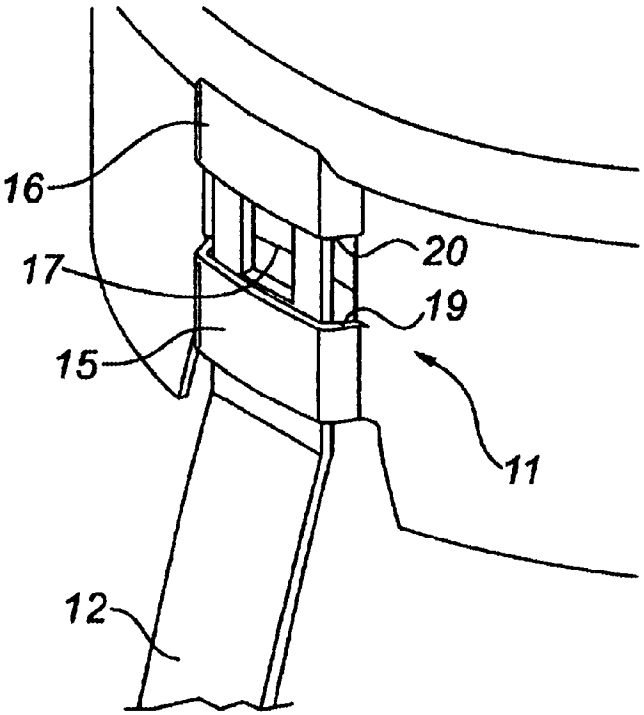
FIG. 4 is another perspective view of one end of a bow spring and a portion of a collar, on an enlarged scale, as seen from the outer surfaces of both, the end of the bow spring having been located within the externally formed upsets of the collar, prior to the internally formed upset being formed into the opening in the end of the bow spring.
Figure 3:
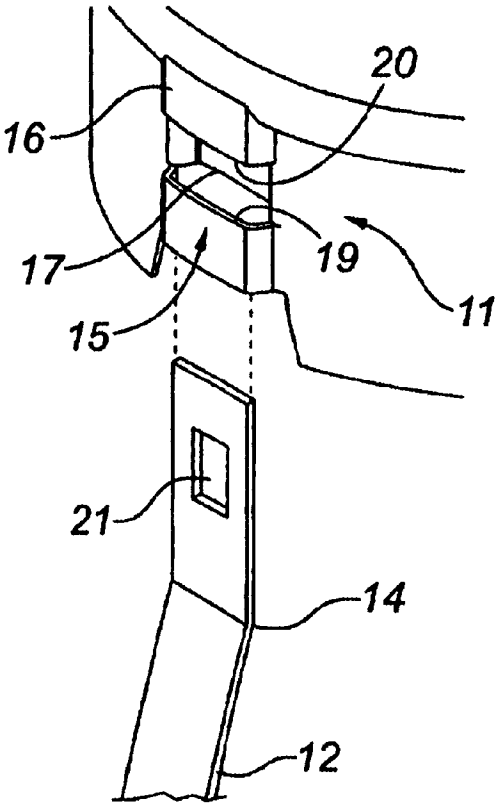
FIG. 3 is an exploded, perspective view of one end of a bow spring and a portion of a collar, on an enlarged scale, and as seen from the outer surfaces of both, the end of the bow spring being located for movement axially into the externally formed upsets of the collar to dispose its end into the external upsets in the collar and to permit the internally formed upset to be formed into opening in the bow spring.
Figure 6:
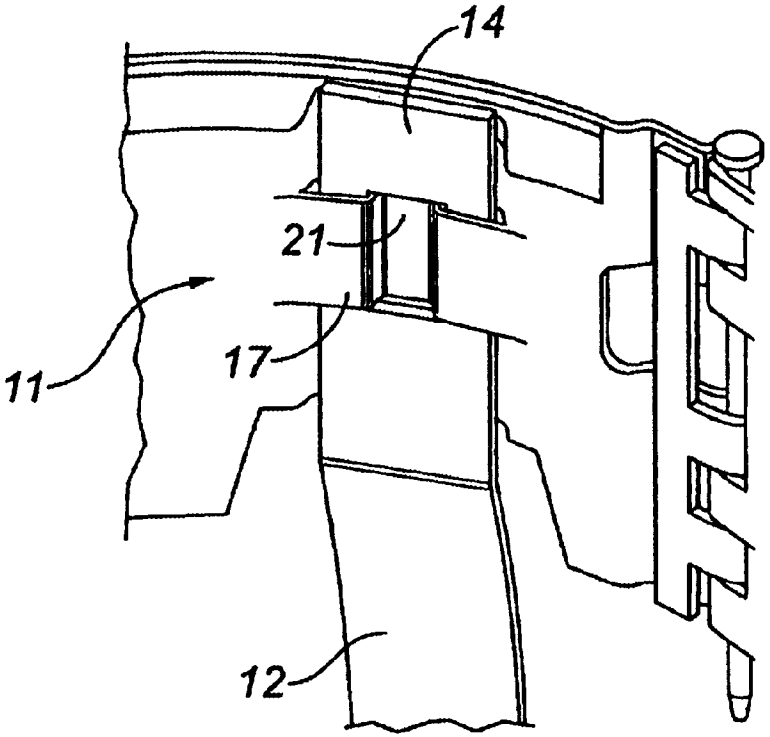
FIG. 6 is another perspective view of one end of a bow spring and a portion of a collar, on an enlarged scale, as seen from the inner surfaces of both, the end of the bow spring having been located within the externally formed upsets of the collar and the internally formed upset between the external upsets having been formed into the opening in the end of the bow spring.
Figure 5:
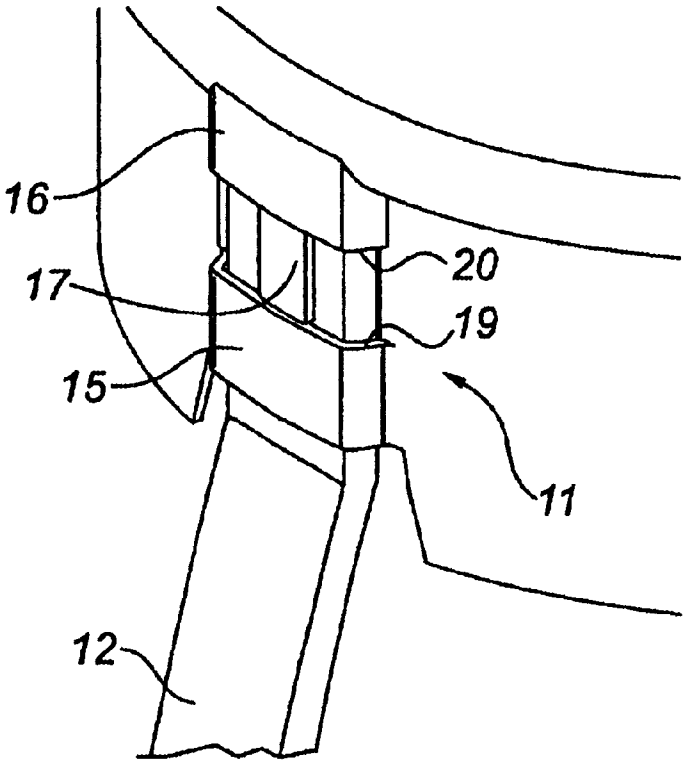
FIG. 5 is another perspective view of one end of the bow spring and a portion of the collar, on an enlarged scale, as seen from the outer surfaces of both, the end of the bow spring having been located within the externally formed upsets of the collar and the internally formed upset between the external upsets having been formed into the opening in the end of the bow spring.

To complete the assembly the internal upset portion of the collar will be formed as shown in FIGS. 3, 4 and 5 is to dispose the intermediate portion of the internal upset within the opening in the bow spring end element with the outer surface of the internal upset being formed to contact the inner surface of the bow spring element. When assembled about the conduit the inner surface of the internal upset material that has been formed into the bow spring openings will have close contact with the conduit and thus retaining the position of the formed internal upset material within the bow spring opening and thus preventing the bow springs from being pulled loose from the end collar.

As with other centralizers of this type the centralizer 10 may be shipped in unassembled condition, and then assembled at the point of use and located about the conduit. As the centralizer components need not be assembled until the time of use they may be stored in a wide variety of sizes of collars and bow spring for assembly into the required configuration at time of use.

The present invention is well adapted to perform the objects and advantages mentioned as well as other inherent therein. While the presently preferred embodiment of the invention is given for the purpose of disclosure, numerous changes in the detail of construction, arrangement of parts, and steps of manufacture, will readily suggest themselves to those skilled in the art and which are encompassed within the spirit of the invention and the scope of the appended claims.

What is claimed is:

1. A casing centralizer, comprising a pair of longitudinally spaced collars adapted to be assembled about a conduit, and a plurality of outwardly bowed springs extending longitudinally between the collars, each collar having internal and external upsets formed therein, the external upsets being generally U shaped to receive the end of the bow spring, each bow spring having an opening at each end thereof adapted to receive the internally upset material, with the internally upset material so formed to extend into the bow spring opening thereby locking the end portion of the bow spring within the externally formed U shaped upsets, the external upsets having upper and lower shoulders that are axially spaced apart a distance substantially equal to the length of the opening in the end of the bow spring.

* * * * *